US008060944B2

(12) United States Patent
Lueking

(10) Patent No.: US 8,060,944 B2
(45) Date of Patent: Nov. 22, 2011

(54) APPARATUS AND METHODS FOR HOLDING SHIN GUARDS IN POSITION

(76) Inventor: Daniel E. Lueking, West Chester, OH (US)

( * ) Notice: Subject to any disclaimer, the term of this patent is extended or adjusted under 35 U.S.C. 154(b) by 1111 days.

(21) Appl. No.: 11/662,163

(22) PCT Filed: Dec. 4, 2006

(86) PCT No.: PCT/US2006/046232

§ 371 (c)(1),
(2), (4) Date: Mar. 7, 2007

(87) PCT Pub. No.: WO2007/064995

PCT Pub. Date: Jun. 7, 2007

(65) Prior Publication Data

US 2009/0235422 A1 Sep. 24, 2009

(51) Int. Cl.
*A41D 13/00* (2006.01)

(52) U.S. Cl. ..... 2/22

(58) Field of Classification Search ..... 2/22–24, 2/911, 239, 240, 242; 602/62, 63; 66/178 R, 66/182, 183

See application file for complete search history.

(56) References Cited

U.S. PATENT DOCUMENTS 4,172,456 A * 10/1979 Zens ..... 602/63
5,742,945 A 4/1998 Lindaman
5,890,224 A 4/1999 Clark
5,926,844 A 7/1999 Bear
6,012,177 A * 1/2000 Cortinovis ..... 2/239

OTHER PUBLICATIONS

International Search Report and Written Opinion dated Aug. 19, 2008 pertaining to International Application No. PCT/US2006/046232.

* cited by examiner

*Primary Examiner* — Tejash Patel
(74) *Attorney, Agent, or Firm* — Dinsmore & Shohl, LLP

(57) ABSTRACT

An apparatus and method for providing a sock for holding shin guards/pads (e.g., soccer shin guards/pads) in position along a player/participant's shin. The apparatus may include an upper section for substantially covering a lower part of a user's leg such as a shin and, optionally, a lower section for substantially covering a player's foot and/or ankle connected to the upper section to form a sock. The upper section has a compression section having a compression factor of less than about 9 inches in order to hold and/or secure a shin-guard in place upon a player/participant's shin. The compression section may comprise an upper compression section and a lower compression section separate and distinct from the upper section.

19 Claims, 2 Drawing Sheets

APPARATUS AND METHODS FOR HOLDING SHIN GUARDS IN POSITION

Figure 1:
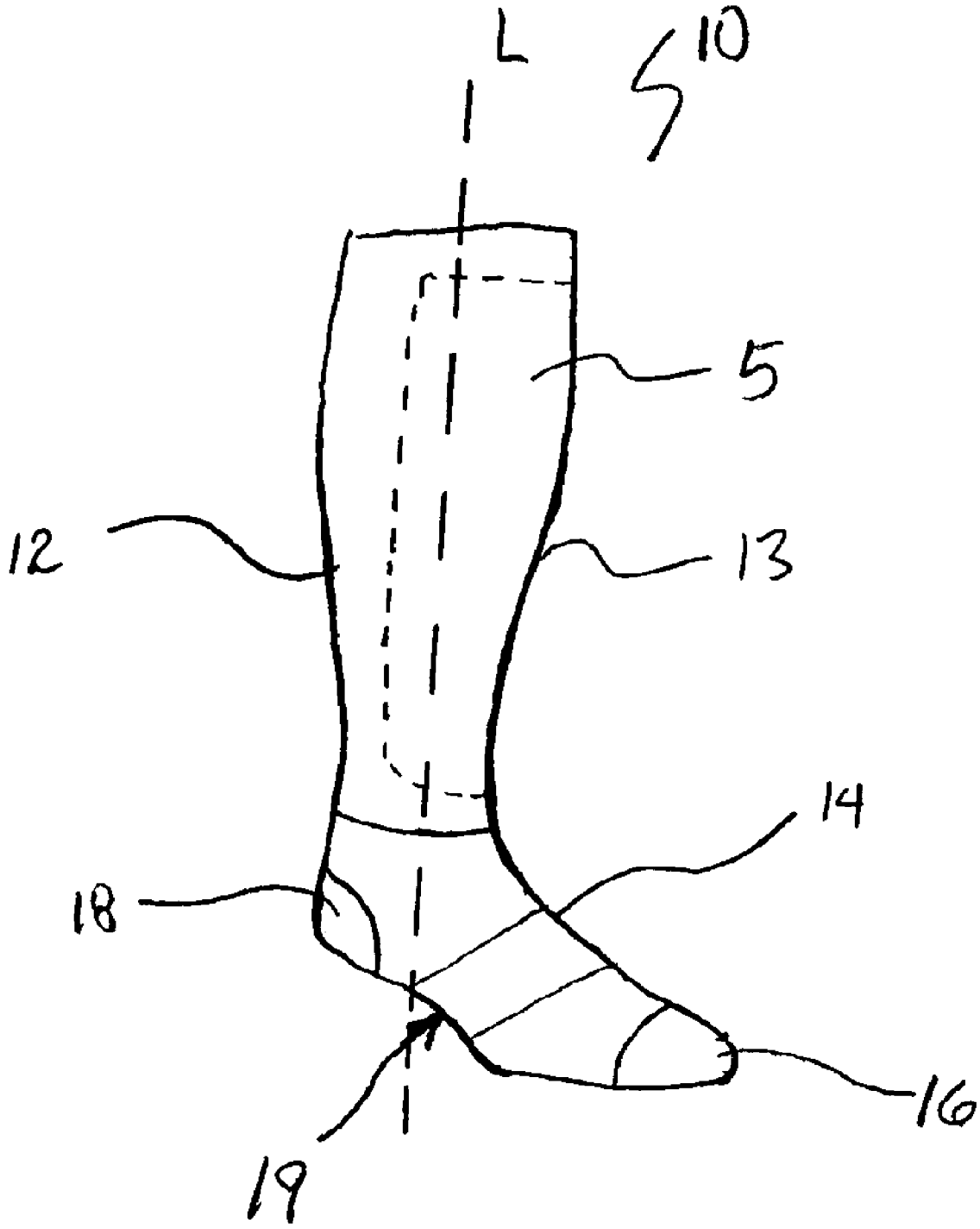

The present invention relates generally to apparatus and methods for holding and securing a shin guard sock. More particularly, the present invention relates to an apparatus and/or sock having a compression factor configured to hold shin guards in position along a user's shin while the user is playing a sport such as a soccer game, hocking, lacrosse, etc.

Participants of many sports such as soccer need to wear protective gear. One type of protective gear worn by these participants, particularly soccer players, is shin guards/pads. Generally, a player positions each shin guard/pad on each shin of their legs and then pulls the socks, e.g., soccer socks up and over the shin guards/pads. Generally, a secondary support method is used to hold the shin guards/pads in position. For example, many shin guards/pads includes straps such as attached Velcro straps that wrap around the participant's lower leg's, securing the shin guards/pads in the proper position. Another secondary support device may include tape (e.g., athletic tape, electrical tape, duct tape, masking tape, box tape, etc.), wherein once the socks are pulled up and over the guards/pads, the player wraps tape around a lower part of the lower leg (e.g., just above the ankle) and around an upper part of the lower leg (e.g., just below the knee). The tape around the lower part of the lower leg may be wrapped around either the lower part of the lower leg only, just below the guard/pad or the lower portion of the guards/pads and leg. The tape around the upper part of the lower leg may be wrapped around either the upper part of the lower leg only, just above the guards/pads or the upper portion of the guards/pads and leg.

However, these devices have rarely worked and do not provide the support and comfort that most players are wanting from such a device. Moreover, such devices may also cause health concerns because they must be so tight around a player's legs that these devices may restrict (cut off) the player's blood flow to their lower extremities such as feet and/or toes.

Accordingly, the present invention is intended to address and obviate problems and shortcomings and otherwise improve previous shin guard support apparatus.

One exemplary embodiment of the present invention is a shin guard sock that comprises a lower portion for substantially covering a user's foot and an upper portion for substantially covering a user's shin and for holding a shin guard in position along a shin connected to the lower portion, wherein the upper portion comprises a compression section having a compression factor of less than 9 inches.

Another exemplary embodiment of the present invention is an apparatus for holding a shin guard along a shin of a soccer player that comprises an upper portion for sliding onto a lower part of a leg having a compression section for securing a shin guard in position upon a player's shin, wherein the compression section has a compression factor of less than about 8 inches to hold a shin-guard in place upon the player's shin.

An exemplary method of the present invention is a method for making a shin guard sock that comprises providing a piece of fabric, forming the piece of fabric into a sock having an upper portion and a lower portion such that the lower portion substantially covers a foot of the player and the upper portion substantially covers a lower leg connected to the foot, and cross-stitching a compression section within the upper portion such that the compression section has a compression factor of less than about 9 inches.

Figure 2:
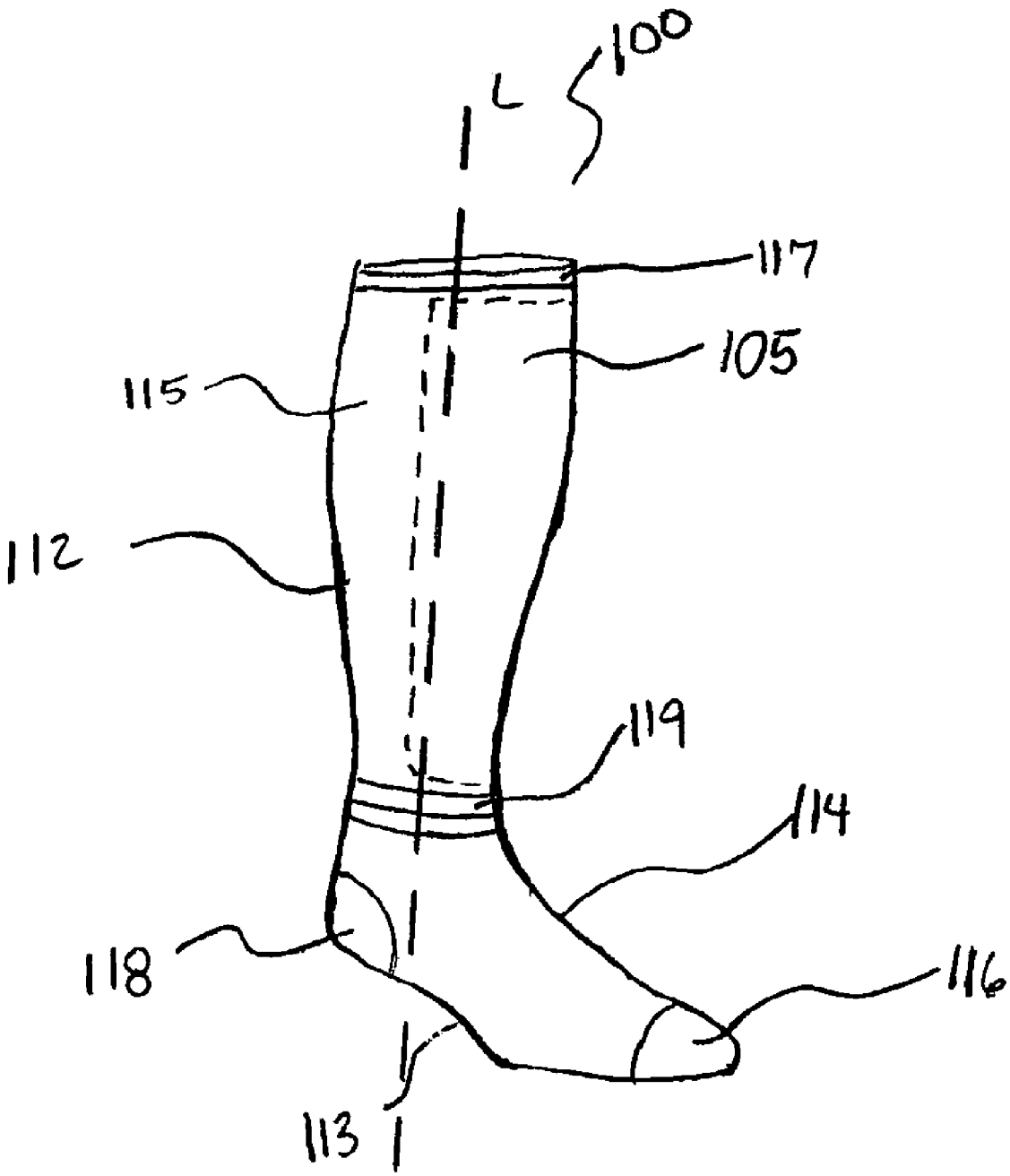

The following detailed description of exemplary embodiments of the present invention can be best understood when read in conjunction with the following drawings, where like structure is indicated with like reference numerals and in which:

FIG. 1 is a schematical representation of an exemplary embodiment of a shin guard sock according to the present invention; and FIG. 2 is a schematical representation of an exemplary embodiment of a shin guard sock according to the present invention.

In the following detailed description of the exemplary embodiments, reference is made to the accompanying drawings that form a part hereof, and in which is shown by way of illustration, and not by way of limitation, specific exemplary embodiments in which the invention may be practiced. It is to be understood that other embodiments may be utilized and that logical and mechanical changes may be made without departing from the spirit and scope of the present invention.

Sport associations, boards, and other organizations charged with establishing and regulating the rules for sporting associations, leagues, etc. (e.g., Ohio High School Athletic Association, National Federation of State High School Associations, etc.) are also beginning to restrict and more strictly enforce on how and where players wear their shin guards. First of all a players shin guards must be covered by the stocking at all times. It is illegal to have a player's shin guards exposed. Secondly a new rule, Rule 4.1 in the NFHS Rule Book, which is what most states adhere to, states, "The required player equipment includes a . . . and shin guards which shall provide adequate and reasonable protection, be professionally manufactured, age- and size-appropriate, not altered to decrease protection, worn under stockings, and worn with the bottom edge no higher than 2 inches above the ankle."

Applicants have discovered apparatus and methods (e.g., a shin guard sock, a sleave) that produces sufficient compressive forces, i.e., radially inwardly forces produced by the elasticity of the material and/or stitch, to hold and secure shin guards/pads in position along a user's (e.g., soccer player/participant) shins without requiring secondary support devices, particularly during participation in games and/or practices, (e.g., soccer games and practices). When insufficient support is provided to the shin guards/pads, the guards/pads move out of position such as down around a player's ankles, restricting a player's foot movement, or no longer properly protecting a player's shins.

Referring to FIG. 1, an exemplary embodiment of an athletic sock according to the present invention is shown generally as 10. In the exemplary embodiment, athletic sock 10 includes an upper portion 12 and a lower portion 14. Upper portion 12 may be configured to substantially cover and/or fit or slide over a person's lower leg (e.g., calf and shin) from approximately just above the ankle to approximately just below the knee. Upper portion 12 may includes a compression section 13 having a compression factor that provides improved and/or increased compressive forces compared to conventional socks, such as soccer socks, such that the shin guard socks of the present invention require no secondary support devices to hold the shin guards/pads in position.

In the exemplary embodiment shown in FIG. 1, compression section 13 comprises the entire, or at least a substantial portion of, upper portion 12. It is understood that compression section 13 may be provided in other configurations. For example, section 13 may have a width measured along a longitudinal axis (L) of upper portion 12 such that compression section 13 comprises something less than the entire or a substantial portion of upper portion 12 (e.g., a width ranging from about 1 inch to about 7 inches). Section 13, in such an exemplary embodiment, may be positioned any where along upper portion 12 such as, for example, positioned in the approximate middle of upper portion 12 (not shown).

Compression section 13 may be configured to have a compression factor of less than about 10 inches, particularly less than about 9 inches, more particularly less than 9 inches, even more particularly from about 4 inches to 9 inches. In another exemplary embodiment, compression section 13 may be configured to have a compression factor less than about 8 inches, more particularly from about 4 inches to about 8 inches. In yet another exemplary embodiment, compression section 13 may be configured to have a compression factor from about 5 inches to about 7 inches. In still yet another exemplary embodiment, compression section 13 may be configured to have a compression factor of about 6 inches.

As used herein, compression factor is defined as the measurement of the stretch or elasticity of a sock, which determines the compressive forces applied by the sock radially inwardly upon the shin guard/pads and/or the leg and/or foot. Compression factor, as used herein, is measured by stretching the sock at any point to its limit or yield point and then measuring the width of the sock at this peak-stretched position before the sock yields as known to one or ordinary skill in the art. For example, if upper portion 12 (i.e., calf portion) of the sock is stretched to its fullest possible width (yield point) and that width is measured as 10 inches, then the sock has a compression factor of 10 inches at its upper portion.

One exemplary methods that may be used to provide compression 13 with the improved compression factor of the present invention is a high compression cross-stitch method as known to one of ordinary skill in the art. Such a high compression cross-stitch method comprises a cross-stitch sufficient enough to provide the compression factor for section 13 as set forth above. One exemplary cross-stitch method that may be modified to achieve the desired compression factor of the present invention is a high compression cross-stitch method used to fabricate medical high compression sections used to improve circulation on human limbs such as legs and arms for medical and heath purposes. Other exemplary materials/methods that may be used to fabricate and/or provide compression section 13 with the compression factor of the present invention include, but are not limited to, high elastic materials imbedded or stitched into or within the sock material of section 13 (e.g., elastomer, rubber, nylon, polymers, natural materials, other synthetic materials, combinations thereof, etc.).

Upper portion 12 having section 13 with the improved compression factor permits a player to slide shin guards/pads underneath upper portion 12 (between the sock's upper portion 12 and the player's shins or a second pair of socks worn underneath sock 10) and hold the shin guards/pads in the proper positions along the player's legs (e.g., shins) for the entire time the guards/pads are in use during a game or practice. Upper portion 12 of the present invention provides the necessary support and compression force required to hold and secure the shin guards/pads in place and/or position without requiring additional secondary support devices (e.g., tape or Velcro straps) to assist sock 10 in holding the shin guards/pads in the proper position.

Sock 10 may also include a lower portion 14 configured to fit and cover the foot of a player/participant (e.g., covering the ankle and foot area). In the exemplary embodiment shown lower portion 14 is connected to or integral to upper portion 12 to form a sock. Lower portion 14 may have a variety of compression factors. Lower portion 14 may comprise a compression factor that is less than compression section 13 of upper portion 12. In one exemplary embodiment, lower portion 14 may have a compression factor of greater than or equal to 9 inches, particularly greater than about 10 inches. In another exemplary embodiment, lower portion 14 comprises a stitch having a compression factor from about 10 inches to about 13 inches. In another exemplary embodiment, lower portion 14 may comprise a compression factor that is the same as or greater than the compression factor of compression section 13 as set forth above herein.

In yet another exemplary embodiment, lower portion 14 may comprise one or more compression sections 19 having an increased compression factor that are strategically positioned to provide increased support to parts of the foot such as arch support. It is understood that compression section 19 may be positioned at other positions along lower portion 14 as well. Compression section 19 may comprise a compression cross-stitch having a compression factor of less than about 10 inches, particularly from about 2 inches to about 9 inches. In one exemplary embodiment, compression section 19 comprises a stitch having a compression factor of from 2 inches to 8 inches. It is understood that lower portion 14 may be comprise completely or substantially of compression section 19.

In still yet another exemplary embodiment, lower portion 14 may include a toe section 16 and a heel section 18. Toe section 16 and/or heel section 18 may be fabricated with a fabric and/or stitch that provides the respective sections with additional reinforcement to provide additional strength and wear for these portions of the foot area (lover portion 14) as known to one of ordinary skill in the art. It is also understood that sock 10 may not include lower portion 14 at all, making sock 10 essentially a sleeve that slides over a player's lower leg, i.e., calf and shin, such that the shin guards may be slid between upper portion 12 and the player's shin.

Referring to FIG. 2, still yet another exemplary embodiment is shown as sock 100. Sock 100 may include an upper portion 112 and a lower portion 114. Upper portion 112 may comprise an upper compression section 117, a lower compression section 119, and a middle section 115 connecting the upper and lower compression sections. Upper compression section 117 may be disposed along or near the top of upper portion 112 (approximately just below a player's knee) such that compression section 117 will be positioned either upon a shin guard/pad or just above the shin guard/pad, when the shin guard/pad is placed within sock 100 upon a player/participant's shin. Lower compression section 119 may be disposed along or near the bottom of upper portion 112 (approximately just above a player's ankle) such that compression section 119 will be positioned either upon a shin guard/pad or just below the shin guard/pad, when the shin guard/pad is placed within sock 10 upon a player/participant's shin.

Upper and lower compression sections 117 and 19 may be fabricated from any conventional materials and methods known to one of ordinary skill in the art and as set forth above with reference to section 13 in the first exemplary embodiment. Compression sections 117 and 119 may be fabricated using a high compression cross stitch, wherein the stitch has a compression factor of less than about 10 inches, particularly equal to or less than about 9 inches. In yet another exemplary embodiment, upper and lower compression sections 117 and 119 have a stitch having a compression factor of less than about 9 inches, particularly from about 4 inches to about 9 inches, more particularly from about 5 inches to about 7 inches. In still yet another exemplary embodiment, upper and lower compression sections 117 and 119 have a stitch having a compression factor of about 6 inches. It is understood that upper and lower compression sections 117 and 119 may be any width along the longitudinal axis (L) of upper section 112

(e.g., from about 0.25 inches to about 4 inches) even such that they may comprise a substantial portion of upper portion 112.

Middle section 115 (disposed between upper and lower compression sections 117 and 119) may be fabricated (e.g., stitched) such that it is integral to both upper and lower sections 117 and 119, respectively. Middle section 115 may comprise materials and fabricated using stitch methods as found in a conventional sock (e.g., soccer socks) as known to one of ordinary skill in the art. In one exemplary embodiment, middle section 115 may comprise a stitch having a compression factor of greater than about 9, particularly greater than about 10, even more particularly from about 10 to about 12. In yet another exemplary embodiment, middle section 115 may comprise a stitch having an improved compression factor such as that describe and set forth above in the exemplary embodiments (e.g., compression factors for upper and lower compression sections 117 and 119). For example, middle section 115 may comprise a third compression section (not shown) similar to the upper and lower compression sections and having the same or similar width along longitudinal axis (L) and compression factors as set forth above for upper and lower compression sections 117 and 119. In still yet another exemplary embodiment, middle section 115 may comprise a stitch having a compression factor from about 7 inches to about 10 inches.

Sock 100, as shown in FIG. 2, also may include lower portion 114 integrally stitched to upper portion 112. Lower portion 114 may also comprise a toe section 116, a heal section 118, and a arch section 113. As set forth above with reference to the first exemplary embodiment shown in FIG. 1, the present exemplary embodiment may also include reinforced toe and heal sections 116 and 118, and arch section 113 may include a stitch having high compression factor of less than about 10 inches, more particularly less than about 9 inches. For example, arch section 113 may comprise a stitch having a compression factor from about 2 inches to about 9 inches.

Sock 100 may be fabricated such that upper portion 112, upper and lower compression sections (117, 119), middle section 115, and lower portion 114 are knitted as one integral unit. In another exemplary embodiment, the compression sections (e.g., 117 and 119) may be stitched or connected to an upper portion of a conventional athletic sock such as a soccer sock. For example, upper compression section 117 which has a compression factor from about 4 inches to about 9 inches may be stitched to middle section 115 which is comprised of a material and stitch used for fabricating a conventional soccer sock, which in turn, may be stitched to lower compression section 119 which has a compression factor from about 4 inches to about 9 inches.

In another exemplary embodiment, the upper section (e.g., upper portion 12 or upper portion 112) may include a pocket (not shown) fabricated from material and configured in shape and size to permit shin guards/pads to be slid into and/or out of the pocket. Such a pocket may be configured such that the shin guard is positioned along a player/participant's shin(s) when the sock(s) (e.g., sock 10 or sock 100) is on the player's leg(s). The pocket and sock's compression factor combine to hold the shin guards in the proper position along a player/participant's shins. The pocket may be fabricated from the same material and stitch as the upper section (e.g., 12, 112) and/or the compression sections (e.g., 13, 117, 119), thus having the same compression factor as set forth above in the exemplary embodiments. In one exemplary embodiment, the pocket comprises upper compression section 117 and lower compression section 119 integral to the pocket's construction. It is understood that the pocket may also be fabricated from other materials and/or stitches.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A shin guard sock, comprising:

a lower portion for substantially covering a user's foot; and an upper portion for substantially covering a user's shin and for holding a shin guard in position along a shin connected to the lower portion;

wherein the lower portion has a compression factor that is greater than 9 inches;

wherein the upper portion comprises a compression section having a compression factor of less than 9 inches.

2. The shin guard sock of claim 1, wherein the compression section has a compression factor from about 4 inches to 9 inches.

3. The shin guard sock of claim 1, wherein the compression section has a compression factor from about 5 inches to about 7 inches.

4. The shin guard sock of claim 1, wherein the compression section has a compression factor of about 6 inches.

5. The shin guard sock of claim 1, wherein the compression section comprises substantially the entire upper portion.

6. The shin guard sock of claim 1, wherein the compression section of the upper portion comprises a first compression section disposed near the top of the upper section and a second compression section, distinct from the first compression section, disposed near the bottom of the upper portion.

7. The shin guard sock of claim 6, wherein the upper portion comprises a third compression section connected to the first and second compression sections, wherein the third section has a compression factor of greater than or equal to about 9 inches.

8. The shin guard sock of claim 6, wherein the upper portion further comprises a third compression section, separate and distinct from the first and second compression sections, and disposed approximately between the first and second compression sections along the upper portion, and wherein the third compression section has a compression factor of less than about 10 inches.

9. The shin guard sock according to claim 8, wherein the third compression section has a compression factor from about 4 inches to about 9 inches.

10. The shin guard sock of claim 1, wherein the lower portion comprises a toe section and a heal section that are reinforced.

11. The shin guard sock of claim 1, wherein the lower portion has a compression factor that is less than the compression factor of the compression section of the upper portion.

12. The shin guard sock of claim 1, further comprising a second compression section disposed in the lower portion, wherein the second compression section having a compression factor of less than about 9 inches.

13. The shin guard sock of claim 1, wherein a shin guard is slid underneath the upper portion of the sock.

14. An apparatus for holding a shin guard along a shin of a soccer player, comprising:

a lower portion for substantially covering a user's foot, wherein the lower portion has a compression factor that is greater than 9 inches; and an upper portion for sliding onto a lower part of a leg having a compression section for securing a shin guard in position upon a player's shin, wherein the compression section has a compression factor of less than about 8 inches to hold a shin-guard in place upon the player's shin.

15. The apparatus of claim 14, wherein the compression section of the upper portion has a compression factor from about 4 inches to about 8 inches.

16. The apparatus of claim 14, wherein the upper portion comprises a pocket for holding a shin guard along a player's shin.

17. A method of holding a shin guard in place, comprising:

placing the sock according to claim 1 onto a lower leg and foot of a person for substantially covering a shin, foot, and the lower leg of the person; and placing a shin guard under the upper portion of the sock between the shin and the upper portion.

18. A method of holding a shin guard in place, comprising:

placing the apparatus according to claim 14 onto a lower leg of a person for substantially covering a shin of the leg; and placing a shin guard under the upper portion of the sock between the shin and the upper portion.

19. A method for making a shin guard sock, comprising:

providing a piece of fabric;

forming the piece of fabric into a sock having an upper portion and a lower portion such that the lower portion substantially covers a foot of the player and the upper portion substantially covers a lower leg connected to the foot;

cross-stitching a compression section within the upper portion operable to hold a shin guard along a shin of a user such that the compression section has a compression factor of less than about 9 inches; and forming the lower portion to have a compression factor of greater than 9 inches.

* * * * *